United States Patent [19]

Bloom

[11] Patent Number: 4,872,594

[45] Date of Patent: Oct. 10, 1989

[54] HAIR COLORING APPLICATOR BOTTLE

[76] Inventor: Robert Bloom, 425 Ascot La., Streamwood, Ill. 60103

[21] Appl. No.: 243,592

[22] Filed: Sep. 12, 1988

[51] Int. Cl.[4] ..... B67D 5/06

[52] U.S. Cl. ..... 222/173; 222/192; 222/108; 222/568; 248/131; 368/10; 215/100 R

[58] Field of Search ..... 222/192, 638, 78, 179.5, 222/23, 48, 39, 173, 571; 221/2, 3; 248/131; 84/94.1, 94.2, 95.1, 95.2; 368/18, 97–99; 215/100 R

[56] References Cited

U.S. PATENT DOCUMENTS

| | | | |
|---|---|---|---|
| 2,529,368 | 11/1950 | Bazelon | 84/95.2 |
| 2,633,845 | 4/1953 | Peretti | 222/108 |
| 2,929,290 | 3/1960 | Smith | 84/95.2 |
| 3,523,630 | 8/1970 | Catapano | 222/568 |
| 4,049,160 | 9/1977 | Rutsm | 222/568 |
| 4,361,408 | 11/1982 | Wirtschafter | 222/638 |
| 4,367,955 | 1/1983 | Ballew | 368/98 |
| 4,473,097 | 9/1984 | Knickerbocker et al. | 222/158 |

*Primary Examiner*—H. Grant Skaggs

*Attorney, Agent, or Firm*—Dressler, Goldsmith, Shore, Sutker & Milnamow, Ltd.

[57] ABSTRACT

A hair coloring applicator bottle including, in an axially aligned relation, and applicator spout including a base portion and an applicator tip portion, an elongated liquid receptacle, a timer mechanism, and a base. Time period indicia and timer pointer indicia are alternately provided on the liquid receptacle and base for setting the timer mechanism. The liquid receptacle includes a collapsible plastic container and a container holder. The plastic container defines an open mouth which is removably closed by the applicator spout. The timer mechanism is secured to the container holder and includes a timer shaft which rotates relative to the timer mechanism, and is connected to the base. By such construction, the base is secured to the container housing in a manner preventing separation of the liquid receptacle from the timer mechanism. An annular reservoir surrounds the base of the applicator tip portion for capturing excess hair coloring mixture which inadvertently escapes from the applicator tip portion.

9 Claims, 1 Drawing Sheet

HAIR COLORING APPLICATOR BOTTLE

FIELD OF THE INVENTION

The present invention relates to bottles, and, more particularly, to a hair coloring applicator bottle with a timer mechanism.

BACKGROUND OF THE INVENTION

Typical hair coloring techniques involve preparing a hair color mixture. Hair color mixtures typically include a hair coloring ingredient which is admixed with a developing lotion. The developing lotion is usually contained in an applicatior bottle to which the hair coloring ingredient is added. Before applying the resultant color mixture, the hair coloring ingredient and developing lotion interact for a predetermined time period.

Hair coloring is often performed by trained professional hairdressers in beauty salons. Hairdressers commonly work on more than one individual at a time. Rather than sitting idle while the hair coloring ingredients for one customer are interacting, a hairdresser often fills this time by caring for other customers as by cutting hair, providing permanents, or a multitude of other hair care operations.

All hair coloring applications must be timed. The length or period of time that the ingredients need to react with each other is relatively short. The length or period of time the resultant color mixture is applied to the hair varies as a function of several factors. Other hair care operations being concurrently performed by a busy professional hairdresser also fill relatively short time periods. During busy periods in the salon, it is difficult, at best, for a hairdresser to timely coordinate all of these ongoing activities. Yet, unless hair coloring applications are timed, the result for the customer may be other than that desired.

In view of such demanding time requirements, separate timers are a common sight in beauty salons. Such timers are selectively set to monitor and measure time and are located proximate to the particular hair coloring bottle for which the time is being measured or monitored.

Hair coloring applicator bottles and timers are separate items which lead to problems when trying to identify which applicator bottle and timer belong together. Separation of the timer from the applicator bottle further complicates the hair coloring process.

SUMMARY OF THE INVENTION

In view of the above, and in accordance with the present invention, there is provided a hair coloring applicator bottle with a timer mechanism connected thereto. In a preferred form, the timer mechanism is mounted on a base of the applicator bottle. The timer mechanism is mounted such that the hairdresser can quickly assess the amount of time remaining for a particular hair coloring process or procedure.

More specifically, the hair coloring applicator bottle of the present invention includes, preferably in an axially aligned relationship, an applicator spout, an elongated liquid receptacle, a timer mechanism, and a base. Time period indicia is provided on either the liquid receptacle or the base. Timer pointer indicia is arranged in combination with the time period indicia. As will be appreciated, the timer pointer indicia is on the other of the liquid receptacle or the base. The liquid receptacle can be rotated relative to the base to selectively position the time period indicia relative to the timer pointer indicia to selectively set the timer mechanism.

In a preferred form of the invention, the liquid receptacle includes an elongated and collapsible plastic container having an open mouth portion defining a discharge end of the receptacle. The liquid receptacle further includes a container holder arranged at the end of the plastic container opposite the open mouth. To facilitate a proper mixture of ingredients within the container, the container is preferably translucent and has liquid volume indicia thereon.

The applicator spout is removably secured to the discharge end of the liquid receptacle. In this regard, the applicator spout defines an internal thread which is screwably engaged with an external thread provided on the mouth portion of the container. The applicator spout includes a base portion and a frusto-conically shaped applicator tip portion which axially extends from the base portion of the spout. The applicator tip portion defines a fluid passage the size of which changes along its axial length. A concave recessed area is provided at the lower end of the applicator tip portion. This recessed area acts as a reservoir for any excess hair coloring liquid that may flow along the outside of the applicator tip portion.

The design of the applicator spout facilitates the hair coloring application for the hairdresser. Because the size of the fluid passage changes along the axial length of the applicator spout, the outlet opening of the applicator spout can be relatively small or enlarged depending at what height and angle the applicator tip portion is cut through from the base portion of the applicator spout.

All hair coloring mixtures when oxidized "brown out," i.e, they look the same. To avoid confusion of which applicator bottle contains which hair coloring mixture, it is desirable to manufacture the applicator bottle in different colors to simplify identification.

Preferably, the timer pointer indicia is provided on the base and the time period indicia is provided on the liquid receptacle. By such construction, the time period indicia rotates when the applicator bottle is placed on its base.

The timer mechanism of the present invention is secured to the container holder and includes a timer shaft. The timer shaft rotates relative to the timer mechanism and is connected to the base of the bottle in a manner preventing separation of the liquid receptacle from the timer mechanism. In one form, the timer mechanism produces a signal upon expiration of a preset time period.

With the timer mechanism of the present invention connected to the applicator bottle, the problem of disassociation of these two elements has been eliminated. Moreover, the timer mechanism of the present invention permits the operator to quickly assess the amount of time remaining for a particular hair coloring procedure or process thereby facilitating time management for a professional hairdresser.

Other features and advantages of the present invention will become readily apparent from the following detailed description, appended drawings, and accompanying claims.

DETAILED OF THE PRESENT INVENTION

Figure 1:
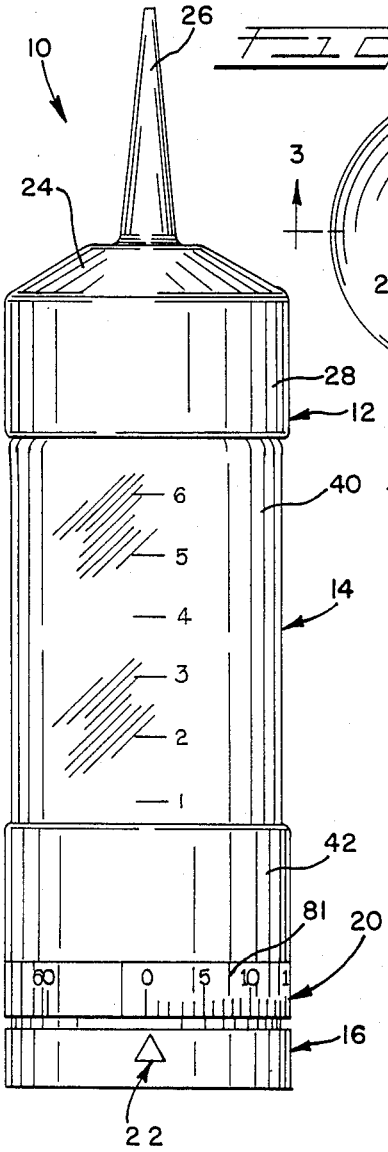
FIG. 1 is a front elevational view of a hair coloring applicator bottle constructed in accordance with the principles of the present invention.
Figure 2:
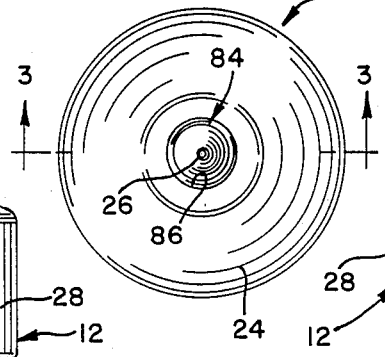
FIG. 2 is a top plan view of the hair coloring applicator bottle illustrated in FIG. 1.

While the present invention is susceptible of embodiments in various forms, there is shown in the drawings and will hereinafter be described, a presently preferred embodiment of the invention with the understanding that the present disclosure is to be considered as an exemplification of the invention, and is not intended to limit the invention to the specific embodiment illustrated.

Figure 3:
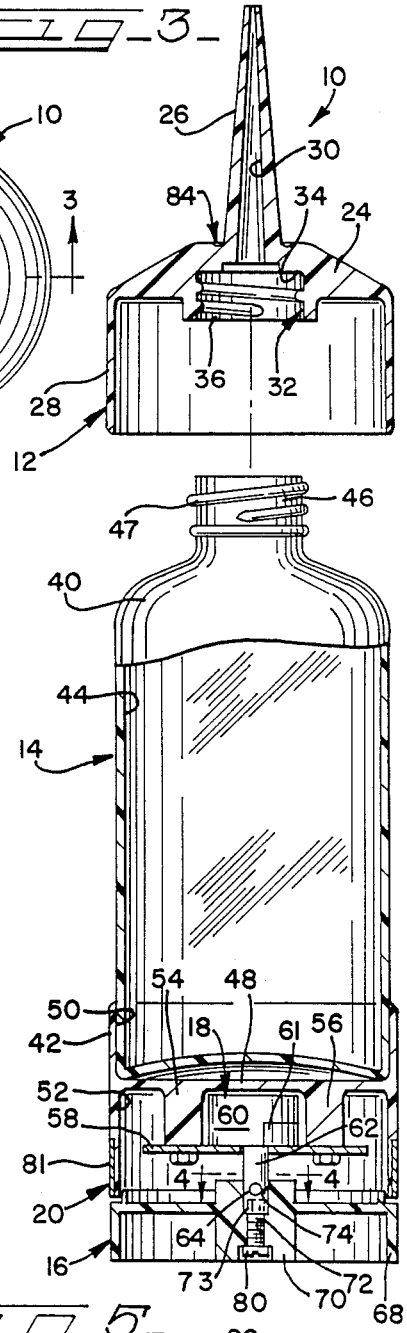
FIG. 3 is a sectional view taken along line 3—3 of FIG. 2.

Referring now to the drawings wherein like reference numerals indicate like parts throughout the several views, there is illustrated a refillable hair coloring applicator bottle 10. In its presently preferred form, bottle 10 includes, in axial aligned order, an applicator spout 12, a liquid receptacle 14, and a base 16 connected to the liquid receptacle 14. Turning to FIG. 3, a timer mechanism 18 operably interconnects base 16 with liquid receptacle 14. Returning to FIG. 1, time period indicia 20 is provided on the liquid receptacle 14. Timer pointer indicia 22 is provided on the base 16. As will be appreciated, the location of the time period indicia 20 and timer pointer indicia 22 could be readily reversed without detracting from the spirit or scope of the present invention.

As illustrated, applicator spout 12 is adapted to be removably secured to the liquid receptacle 14 and may be formed of a suitable synthetic resin such as polyethylene or polypropylene. Spout 12 is of a generally circular configuration and includes a base portion 24 and a frusto-conically shaped applicator tip portion 26 axially extending from base portion 24. As presently preferred, base portion 24 includes a depending cylindrical skirt wall 28 adapted to encircle an upper end of the liquid receptacle or container 14.

Spout 12 defines a fluid passage 30 which extends through the base portion and axially along the length of the applicator tip portion 26. As illustrated in FIG. 3, the cross-sectional size of fluid passage 30 changes along its axial length.

Applicator spout 12 may be plated or painted in different colors to simplify identification of a particular bottle.

Spout 12 further defines a circular central recessed portion 32 which is axially with passage 30. Recessed portion 32 defines an annular sealing end wall 34 and an internal thread 36. If desired, a separate sealing member made of a different synthetic resin, etc., may be disposed in the recessed portion instead of forming the annular sealing end wall integral with the applicator spout.

Liquid receptacle 14 includes an axially elongated liquid receiving container 40 and a container holder 42. As illustrated in FIG. 3, container 40 is formed from a collapsible plastic material and defines a liquid receiving chamber or cavity 44. Preferably, the plastic material forming container 40 is translucent and has liquid volume indicia thereon. Container 40 further defines an open mouth or neck portion 46 defining a discharge end of the liquid receptacle 14. The mouth or neck portion 46 is cylindrical in shape and on its peripheral surface is formed with an external thread 47 which is adapted to cooperate with the internal thread 36 on application spout 12.

Container holder 42 is affixed to the opposite end of container 40. Holder 42 is preferably formed as a cylindrical member having an annular wall or web 48 provided intermediate its ends. Web 48 effectively divides holder 42 into first and second open ended chambers 50 and 52. Chamber 50 is sized to securely accommodate container 40. A pair of legs 54 and 56 extend into chamber 52 and depend from web 48.

To facilitate timing of a hair coloring mixture, timer mechanism 18 is arranged in combination with the liquid receptacle 14. As illustrated, timer mechanism 18 includes a mounting plate 58 and a timer assembly 60 suitably affixed thereto. Mounting plate 58 allows the timer mechanism 18 to be secured to the container housing 42 as by suitable securement to the free ends of the legs 54 and 56 depending from the annular web 48.

The timer assembly 60 may be of the type sold by Pop Corporation of Seoul, Korea under Model No. BT-21. Suffice it to say, timer assembly 60 is a spring action timer having a rotatable timer shaft 62 depending therefrom and extending through the mounting plate 58. In its preferred form, timer assembly 60 includes suitable means 61 for producing a signal, preferably in the form of an audible sound, upon expiration of a predetermined time period. Timer shaft 62 is provided with a cross pin 64 arranged toward a lower end of the shaft 62.

Base 16 is rotatably interconnected, preferably in an axially aligned relation, with the liquid receptacle 14 for normally maintaining bottle 10 in a generally vertical orientation. In its preferred form, base 16 includes a cylindrical skirt wall 68 and a centrally arranged post 70 which is connected to the skirt wall 68. Skirt wall 68 of base 16 is sized to provide vertical stability to the bottle 10. As illustrated, skirt wall 68 is substantially the same diameter as container housing 42.

Post 70 defines an axially extending counterbore 72 which extends therethrough and defines a shoulder 73. The larger diameter portion 74 of bore 72 is adapted to receive the free end of timer shaft 62.

Figure 4:
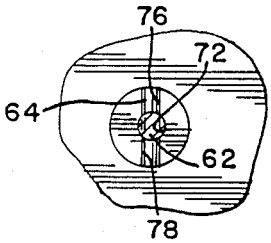
FIG. 4 is a fragmentary top plan view taken along line 4—4 of FIG. 3.

Turning to FIG. 4, post 70 further defines a pair diametrically opposed slots 76 and 78 which radially extend outward from counterbore 72. Slots 76 and 78 are sized to accommodate cross pin 64 therewithin. An upwardly extending fastener 80 threadably engages the free end of timer shaft 62 and secures base 16 to container housing 42 in a manner preventing the separation of liquid receptacle 14 from its associated timer mechanism 18.

The timer period indicia 20 and timer pointer indicia 22 are provided on bottle 10 to facilitate setting of the timer mechanism 18. In one form, the time period indicia 20 is a circular band 81 (FIG. 3) which is preferably secured to container housing 42. As best illustrated in FIG. 1, the time period indicia is graduated in time increments. The timer pointer indicia 22 is preferably arranged on the skirt wall 68 of base 16. Timer pointer indicia may comprise a projection, groove or other suitable form of pointer which, when viewed in combination with the time period indicia 20, readily indicates how much time remains before the end of a selected predetermined time period.

Figure 5:
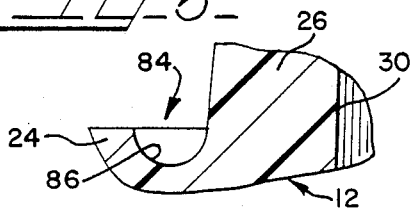
FIG. 5 is an enlarged sectional view detailing a recessed area provided on the applicator spout of the present invention.

As best illustrated in FIGS. 3 and 5, the applicator spout 12 further defines an annular reservoir 84 for capturing any excess hair coloring mixture which inadvertently escapes from the applicator tip portion 26. In a preferred form of the invention, reservoir 84 is defined by an annular, shallow, concave recess 86 defined by the base portion 24 of spout 12 surrounding the applicator tip 26.

The hair coloring applicator bottle 10 of the present invention is easy to manufacture and is relatively simply in construction. By having timer mechanism 18 affixed to the container 40, the problem of maintaining integrity between the applicator bottle and timer mechanism has been eliminated. The timer mechanism 18 may be selectively set as required and provides a signal indicative of the expiration of a predetermined time period set by the operator. The time period indicia 20 and timer pointer indicia 22 provide quick and ready access to the time remaining in the predetermined set time period in a manner facilitating time management. Having container 40 formed from a translucent plastic with volume indicia facilitates preparation of the hair coloring mixture.

When the applicator spout 12 is secured to the liquid receptacle 14, the sealing end wall 34 removably seals the discharge end of the liquid receptacle 14. Having the fluid passage 30 vary in size as a function of its length readily lends the spout 12 to different hair coloring applications. That is, the size of the outlet for the fluid passage 30 may be varied depending on whether a root application or a overall hair coloring treatment is to be performed on the customer. Moreover, reservoir 84 at the base of the applicator tip 26 will capture inadvertent excess hair coloring mixture that along from the applicator tip portion 26.

Thus, there has been described numerous modifications and variations which can be effected without departing from the true spirit and scope of the novel concept of the present invention. It will be appreciated that the present disclosure is intended as an exemplification of the invention, and is not intended to limit the invention to the specific embodiment illustrated. The disclosure is intended to cover by the appended claims all such modifications as fall within the scope of the claims.

What is claimed is:

1. A hair coloring applicator bottle comprising:

liquid receptacle means for receiving and containing hair coloring liquids therein;

an applicator spout removably secured to a discharge end of said receptacle means;

a base rotatably arranged at an opposite end of said receptacle means for normally maintaining said receptacle means in a vertical orientation;

a timer mechanism operably interconnecting said liquid receptacle means and said base;

time period indicia on one of said receptacle means and said base;

timer pointer indicia on the other said receptacle means and said base whereby said receptacle means and said base can be relatively rotated to selectively position the time period indicia relative to said timer pointer indicia to set the timer mechanism.

2. The hair coloring applicator bottle of claim 1 wherein said liquid receptacle means includes an elongated plastic container having an open mouth portion defining the discharge end of said receptacle means and a container holder arranged at the end of said container opposite said open mouth.

3. The hair coloring applicator bottle of claim 2 wherein said open mouth portion of said container has formed on its peripheral surface an external thread, and wherein said spout further defines an internal thread to be screwably engaged with the external thread on the mouth portion of said container.

4. The hair coloring applicator bottle of claim 2 wherein said timer mechanism is secured to said container holder and includes a timer shaft which rotates relative to said timer mechanism and is connected to said base.

5. The hair coloring applicator bottle of claim 2 wherein said plastic container is translucent and has liquid volume indicia thereon.

6. The hair coloring applicator bottle of claim 1 wherein said time pointer indicia is provided on said base and said time period indicia is provided on said receptacle means whereby said time period indicia rotates when the applicator bottle is placed on its base.

7. The hair coloring applicator bottle of claim 1 wherein said spout includes a base portion from which a frusto-conically shaped applicator tip portion axially extends, said applicator tip portion defining an open fluid passage whose size changes along its axial length.

8. The hair coloring applicator bottle of claim 7 wherein said base portion of said spout defines a concave recess surrounding a lowermost end of said applicator tip portion.

9. The hair coloring bottle of claim 1 wherein said timer mechanism includes means for producing an audible signal upon expiration of a predetermined time period set on said timer mechanism.

* * * * *